US010597119B1

(12) United States Patent
Lambert et al.

(10) Patent No.: US 10,597,119 B1
(45) Date of Patent: Mar. 24, 2020

(54) FOLDING BIMINI TOP FRAME

(71) Applicant: Protomet Corporation, Oak Ridge, TN (US)

(72) Inventors: Dale Lee Lambert, Oak Ridge, TN (US); Michael Shane Garner, Philadelphia, PA (US); William Matthew Reid, Knoxville, TN (US)

( * ) Notice: Subject to any disclaimer, the term of this patent is extended or adjusted under 35 U.S.C. 154(b) by 0 days.

(21) Appl. No.: 15/875,357

(22) Filed: Jan. 19, 2018

Related U.S. Application Data

(60) Provisional application No. 62/447,035, filed on Jan. 17, 2017.

(51) Int. Cl.
*B63B 17/02* (2006.01)

(52) U.S. Cl.
CPC ..... *B63B 17/02* (2013.01)

(58) Field of Classification Search
CPC ..... B63B 17/02; E05D 11/10
See application file for complete search history.

(56) References Cited

U.S. PATENT DOCUMENTS

| | | | |
|---|---|---|---|
| 2,823,684 | A | 2/1958 | Sartori |
| 3,001,212 | A | 9/1961 | Towne |
| 4,286,353 | A | 9/1981 | Roche |
| 4,593,641 | A | 6/1986 | Adams et al. |
| 4,683,900 | A | 8/1987 | Carmichael |
| 4,926,782 | A | 5/1990 | Lacy |
| 5,240,020 | A | 8/1993 | Byers |
| 5,681,045 | A | 10/1997 | Liao |
| 5,803,104 | A | 9/1998 | Pollen |
| 5,918,613 | A | 7/1999 | Larson |
| 6,142,438 | A | 11/2000 | Cooper et al. |
| 6,257,261 | B1 | 7/2001 | Johnson |
| 6,349,666 | B1 | 2/2002 | Hastings |
| 6,439,150 | B1 | 8/2002 | Murphy et al. |
| 6,478,500 | B1 | 11/2002 | Farenholtz |
| 6,711,783 | B2 | 3/2004 | LeMole |
| 6,799,529 | B1 | 10/2004 | Willis |
| 6,820,569 | B2 | 11/2004 | Warfel et al. |

(Continued)

FOREIGN PATENT DOCUMENTS

| | | | | |
|---|---|---|---|---|
| NL | 1018648 C2 * | 2/2003 | ..... | B62B 9/20 |
| WO | WO-9847753 A1 * | 10/1998 | ..... | B62B 9/20 |

*Primary Examiner* — Anthony D Wiest
(74) *Attorney, Agent, or Firm* — Matthew M. Googe; Robinson IP Law, PLLC

(57) ABSTRACT

A folding bimini top frame includes: first frame associated with a second frame portion with a first latching hinge, the first latching hinge movable between a folded position and a deployed and locked position, the first latching hinge including a release lever for releasing the first frame from the deployed and locked position; a second latching hinge located between the second frame member and a base of the folding bimini top frame, the second latching hinge pivotable between a folded position and a deployed and locked position, the second latching hinge including a releasable latch for securing the second latching hinge in the deployed position; and a latch release mechanism in communication with the first latching hinge and the releasable latch of the second latching hinge, wherein the releasable latch of the second latching hinge is released by the latch release mechanism when the first frame portion is released from the deployed and locked position.

18 Claims, 15 Drawing Sheets

(56) References Cited

U.S. PATENT DOCUMENTS

| | | | | |
|---|---|---|---|---|
| 6,907,642 | B1 | 6/2005 | Czipri | |
| 6,928,766 | B1 | 8/2005 | Goebel et al. | |
| 6,945,188 | B2 | 9/2005 | Eck et al. | |
| 7,040,587 | B2 | 5/2006 | Thompson et al. | |
| 7,131,166 | B2 * | 11/2006 | Cohen | A63C 11/221 16/232 |
| 7,401,569 | B2 | 7/2008 | Jones | |
| 7,418,918 | B2 | 9/2008 | Bierbower et al. | |
| 7,571,691 | B2 | 8/2009 | Russikoff | |
| 7,685,960 | B1 | 3/2010 | Carusello et al. | |
| 7,895,964 | B2 | 3/2011 | Russikoff | |
| 7,950,342 | B2 * | 5/2011 | Russikoff | B63B 17/02 114/361 |
| 8,297,484 | B2 | 10/2012 | Jesewitz et al. | |
| 9,096,291 | B2 * | 8/2015 | Perosino | F16B 1/00 |
| 9,365,264 | B2 | 6/2016 | Perosino et al. | |
| 9,394,735 | B2 * | 7/2016 | Jones | A47D 7/002 |
| 9,752,364 | B2 | 9/2017 | James | |
| 9,855,998 | B2 * | 1/2018 | Perosino | B63B 17/02 |
| 10,286,982 | B2 * | 5/2019 | Sheedy | B63B 17/02 |
| 2008/0022916 | A1 | 1/2008 | Borges et al. | |
| 2012/0032418 | A1 * | 2/2012 | Doucette | B62B 7/14 280/642 |
| 2014/0015209 | A1 * | 1/2014 | Fleming | B62B 7/08 280/32.7 |
| 2016/0368570 | A1 | 12/2016 | Perosino et al. | |
| 2017/0057600 | A1 * | 3/2017 | Hough | B63B 17/02 |

* cited by examiner

FOLDING BIMINI TOP FRAME

CROSS-REFERENCE TO RELATED APPLICATION

This application claims priority to U.S. Provisional Patent Application Ser. No. 62/447,035 for a Folding Bimini Top Frame filed on Jan. 17, 2017, the contents of which are incorporated herein by reference in its entirety.

FIELD

This disclosure relates to the field of shade covers for watercraft. More particularly, this disclosure relates to a folding bimini top frame that is easily movable between folded and deployed positions.

BACKGROUND

Bimini tops are frequently installed on boats and other watercraft to provide shade or shelter to passengers of the watercraft. A traditional bimini top includes a canvas cover that is supported by a frame above passengers of the watercraft. These bimini tops are typically collapsible such that the bimini top is stowed when shade or shelter is not needed or during storage of the watercraft. While some bimini tops are foldable or otherwise collapsible when the top is not in use, collapsing or storing these tops is typically time consuming, difficult, and cumbersome, often times requiring assistance from more than one user to complete the process of collapsing a typical bimini top.

What is needed, therefore, is a folding bimini top frame that is easily folded for storage and unfolded for deployment to provide shade on a watercraft.

SUMMARY

The above and other needs are met by a folding bimini top frame that is easily folded for storage and unfolded for deployment to provide shade on a watercraft. In a first aspect, a folding bimini top frame includes: a first frame portion pivotally associated with a second frame portion with a first latching hinge, the first latching hinge movable between a folded position and a deployed and locked position, the first latching hinge including a release lever for releasing the first frame portion from the deployed and locked position; a second latching hinge located between the second frame member and a base of the folding bimini top frame, the second latching hinge pivotable between a folded position and a deployed and locked position, the second latching hinge including a releasable latch for securing the second latching hinge in the deployed position; and a latch release mechanism in communication with the first latching hinge and the releasable latch of the second latching hinge, wherein the releasable latch of the second latching hinge is released by the latch release mechanism when the first frame portion is released from the deployed and locked position.

In one embodiment, the folding bimini top frame further includes a rear hoop movably attached to the base of the folding bimini top frame movable between a stowed position and a deployed position.

In another embodiment, the latch release mechanism comprises a cable attached at a first end to the first latching hinge and at a second end to the releasable latch of the second latching hinge.

In yet another embodiment, the first latching hinge further including a cam pivotally associated with the first latching hinge, wherein the cam rotates when the first latching hinge moves between the folded position and the deployed position, and wherein when the first latching hinge pivots from the deployed position to the folded position, the cable releases the releasable latch of the second latching hinge.

In one embodiment, the first latching hinge further includes: a pivot body pivotally attached to a lock body; a cam attached to the pivot body, the cam including a first cam bore formed therethrough; a lock pin movably attached to the lock body and in communication with the release lever and shaped to engage the first cam bore formed through the cam. The lock pin engages the first cam bore of the cam to secure the first latching hinge in the deployed and locked position.

In another embodiment, the first latching hinge further includes a second cam bore formed through the cam attached to the pivot body, wherein the lock pin engages the second cam bore to secure the first latching hinge in the folded position.

In yet another embodiment, the latch release mechanism comprises a cable attached at a first end to the cam of the first latching hinge and at a second end to the releasable latch of the second latching hinge.

In one embodiment, the cable extends from the first latching hinge to the second latching within the second frame portion.

In another embodiment, the second latching hinge further includes: a latch housing pivotally attached to a latch mount, the releasable latch movably mounted on the latch housing; a striker plate attached to the latch mount, the striker plate including an opening shaped to receive the releasable latch when the second latching hinge is in the deployed position.

In yet another embodiment, the folding bimini top frame further includes a plurality of bumpers formed on the latch mount for contacting the second frame portion when the second latching hinge is in the folded position.

In one embodiment, the rear hoop is slidably moved from the stowed position and the deployed position. In another embodiment, the folding bimini top frame is mounted to a top of a tower of a watercraft.

In a second aspect, a folding bimini top frame includes: a first frame portion pivotally associated with a second frame portion with a pair of first latching hinges, each of the pair of first latching hinges movable between a folded position and a deployed and locked position, at least one of the first latching hinge including a release lever for releasing the first frame portion from the deployed and locked position; a pair of second latching hinges located between the second frame member and a base of the folding bimini top frame, the pair of second latching hinges pivotable between a folded position and a deployed and locked position, at least one of the pair of second latching hinges including a releasable latch for securing at least one of the pair of second latching hinges in the deployed position; and a latch release mechanism in communication with one of the first latching hinges and the releasable latch of at least one of the pair of second latching hinges, wherein the releasable latch of the second latching hinge is released by the latch release mechanism when the first frame portion is released from the deployed and locked position.

In one embodiment, the folding bimini top frame further includes a front support arc mounted between the pair of first latching hinges. In another embodiment, the foldable front support arc is pivotally mounted to the pair of first latching hinges.

In yet another embodiment, the folding bimini top frame further includes a rear hoop movably attached to the base of the folding bimini top frame movable between a stowed position and a deployed position.

In one embodiment, the rear hoop is slidably moved from the stowed position and the deployed position. In another embodiment, the folding bimini top frame is mounted to a top of a tower of a watercraft.

In yet another embodiment, the folding bimini top frame further includes a foldable middle support arc extending between the pair of second latching hinges.

In a third aspect, a folding bimini top frame includes: a front latch assembly having a pivot body pivotally attached to a lock body a release lever having a lock pin engaged with the pivot body and lock body, and a release cable connected to the pivot body; at least one pivoting middle latch assembly, the middle latch assembly having a latch movably installed within a latch housing and connected to the release cable, the latch housing pivotally attached to a latch mount and a strike plate attached to the latch mount and having a latch opening for engaging the latch. When a user engages the release lever, the lock pin is disengaged from one of the pivot body and lock body such that the pivot body is free to pivot with respect to the lock body. When the pivot body pivots with respect to the lock body, the release cable disengages the latch of the middle latch assembly from the striker plate, thereby allowing the latch housing to pivot with respect to the latch mount.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
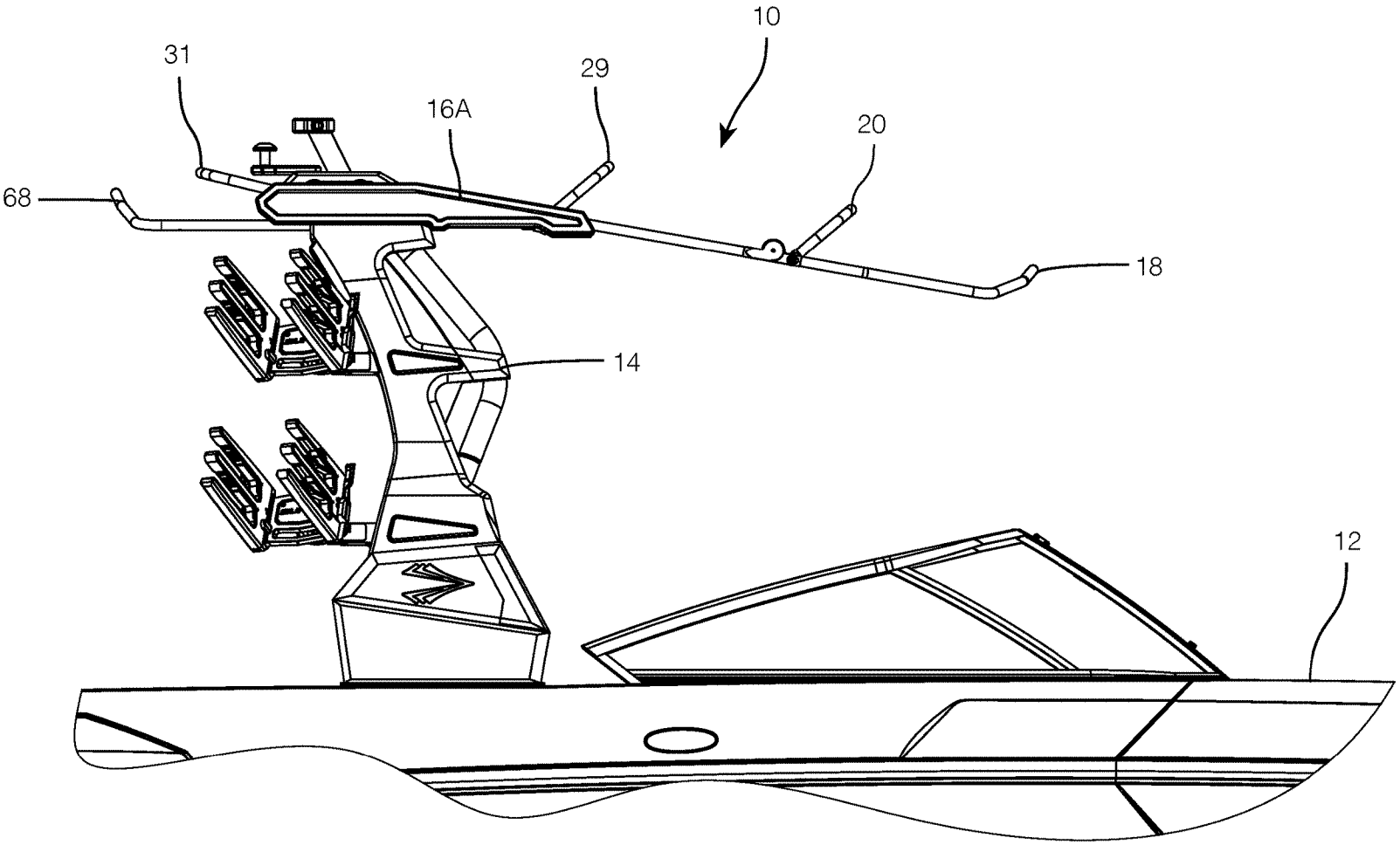
FIG. 1 shows a side view of a watercraft including a folding bimini top according to one embodiment of the present disclosure.
Figure 5:
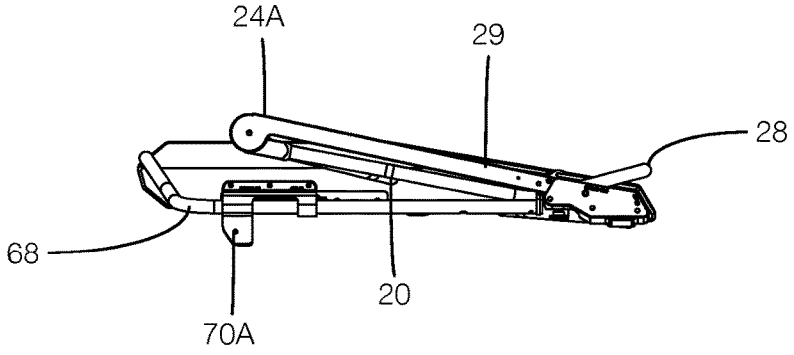
FIG. 5 shows a side view of a folding bimini top in a folded position according to one embodiment of the present disclosure.

FIG. 1 shows a basic embodiment of a folding bimini top frame 10 configured to provide shade or shelter when the bimini top is deployed on a watercraft 12. The bimini top frame 10 is foldable between an open position, as shown in FIG. 1, and a folded or closed position (FIG. 5). In the open position, the folding bimini top frame 10 is deployed and extends towards a bow of the watercraft to provide shade and shelter to passengers of the watercraft 12. In a folded position, the bimini top 10 is compactly folded such that the bimini top frame 10 is no longer deployed to provide shade and shelter to passengers of the watercraft 12. While FIG. 1 shows the folding bimini top frame 10 extending towards a bow of the watercraft 12 in the open position, it is also understood that the folding bimini top may frame 10 be installed such that the top extends towards a stern or starboard or port sides of the watercraft 12.

Figure 3:
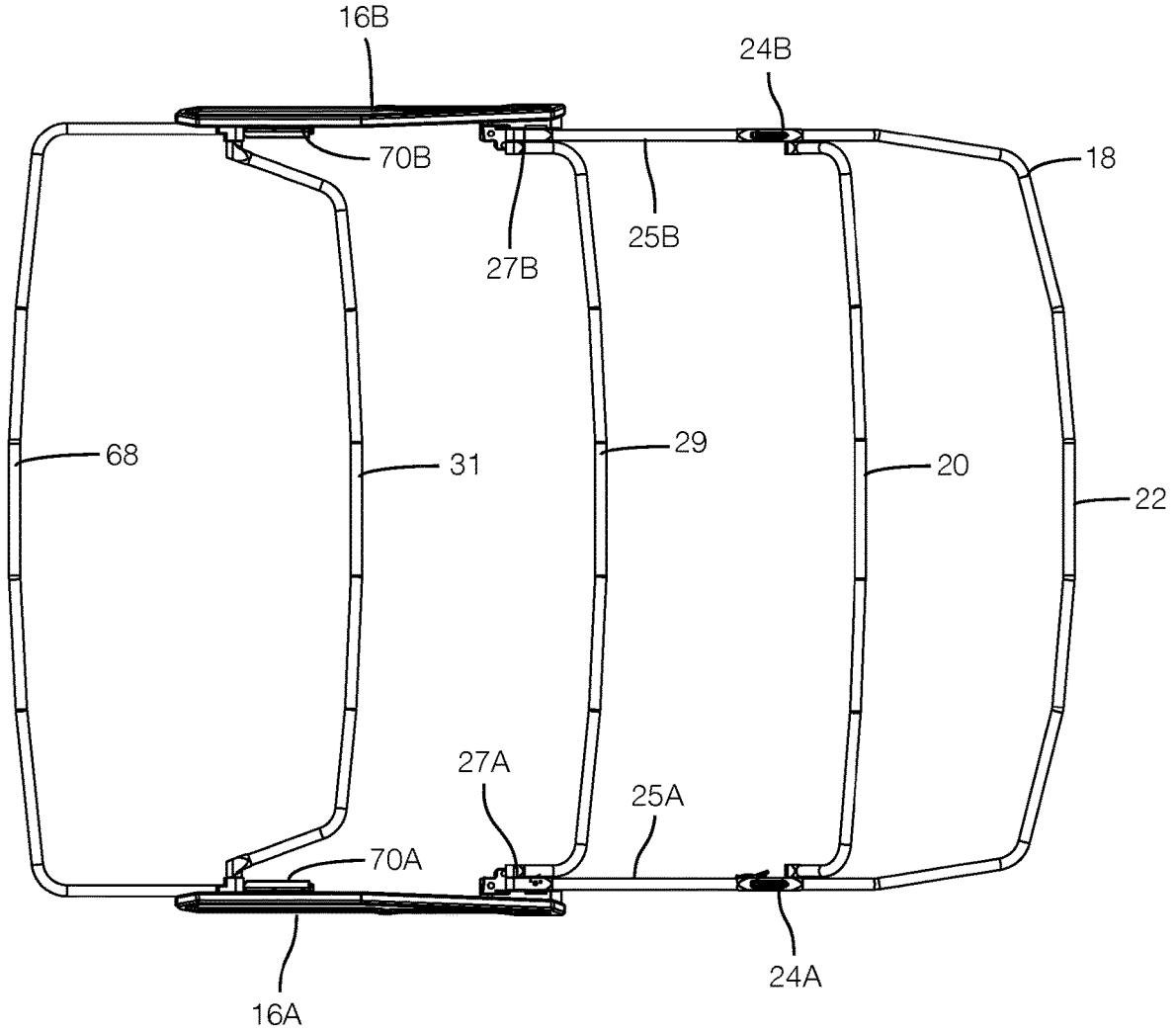
FIG. 3 shows a top view of a folding bimini top in an open position according to one embodiment of the present disclosure.

With further reference to FIG. 1, the folding bimini top frame 10 of the present disclosure is particularly suited for mounting to a tower 14 of the watercraft 12, such as a tower commonly found on wake, ski, or pontoon boats. The folding bimini top frame 10 may be mounted to the tower 14 using end plates 16A and 16B (FIG. 3). The folding bimini top frame 10 may be installed adjacent a top portion of the tower 14 such that sufficient clearance exists between the folding bimini top frame 10 and passengers' heads when the top is in an open position. While FIG. 1 illustrates the folding bimini top frame 10 installed on a tower 14 of a watercraft 12 resembling a wake or ski boat, it is also understood that the folding bimini top frame 10 may be installed on various other surfaces or support structures of a watercraft or other vehicle.

Figure 4:
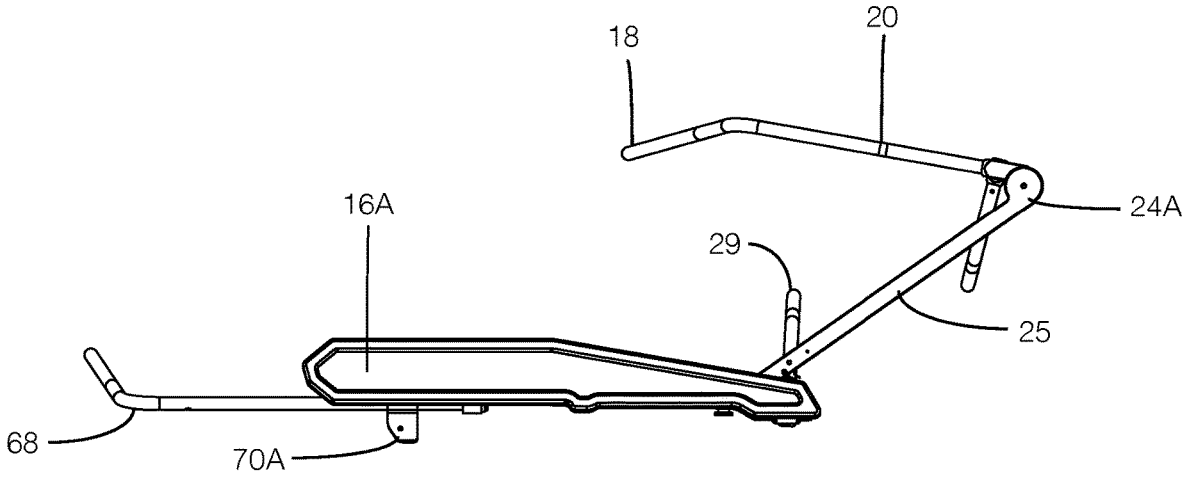
FIG. 4 shows a side view of a folding bimini top in a middle position between open and folded positions according to one embodiment of the present disclosure.

The folding bimini top frame 10 includes a front hoop 18 having a foldable front support arc 20 extending across a width of the front hoop 18. As shown in FIG. 3, the front hoop 18 preferably has a tapered width such that the front hoop 18 narrows towards an end 22 of the front hoop 18. The end of the front hoop 18 is preferably upwardly curved (FIG. 2) for supporting a cover above the front hoop 18 as discussed in greater detail below. The front support arc 20 is preferably pivotally attached to the front hoop 18 such that the front support arc 20 may fold flat (FIGS. 4 and 5) relative to the front hoop 18 when the folding bimini top 10 is in the folded position. Ends of the front hoop assembly 18 are attached to front latch assemblies 24A and 24B. Middle frame members 25A and 25B extend from the front latch assemblies to middle latch assemblies 27A and 27B. A middle support arc 29 extends between the middle latch assemblies 27A and 27B and is pivotally attached to the middle latch assemblies as described in greater detail below. A rear support arc 31 is pivotally attached to the end plates 16A and 16B.

Figure 6:
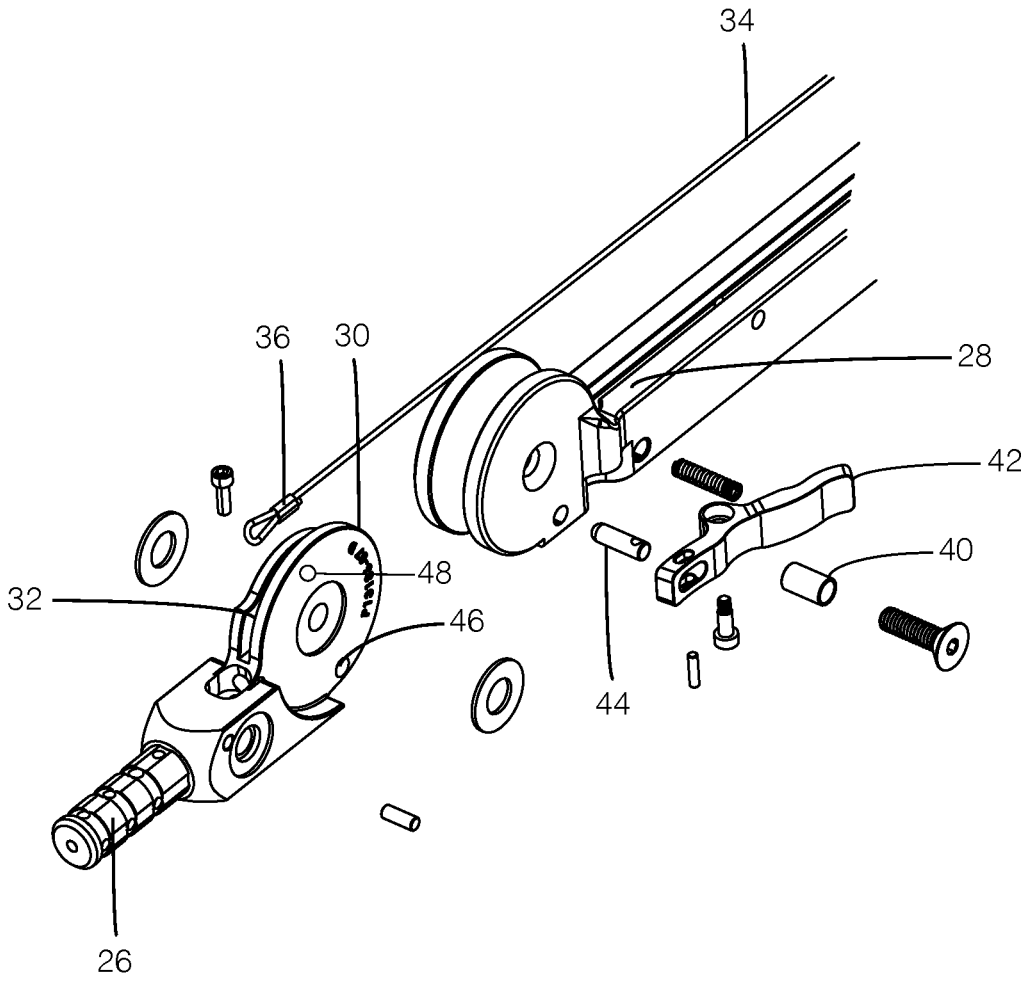
FIG. 6 shows an exploded view of a front latch assembly of a folding bimini top according to one embodiment of the present disclosure.

While the description below references one of latch assemblies 24A and 24B, it is understood that latch assemblies 24A and 24B are substantially identical opposing assemblies except as otherwise described. Referring to FIG. 6, front latch assembly 24 includes a front hoop pivot body 26 pivotally attached to a front hoop lock body 28. The front hoop pivot body 26 includes a cam 30 attached to the pivot body 26 having a groove 32 for guiding a latch release cable 34. The latch release cable 34 includes cable stop 36 attached to an end of the latch release cable 34. Latch release cable 34 may be inserted through a bore in the front hoop pivot body 26 such that the cable is positioned adjacent to the groove 32 of cam 30. The bore is preferably sized such that a diameter of the bore is less than a diameter of cable stop 36, thereby securing the latch release cable 34 to the hoop pivot body 26. A pivot bolt 38 is inserted through the front hoop pivot body 26 and the front hoop lock body 28 such that the pivot body 26 is pivotally secured to the lock body 28.

The lock body 28 is attached to one of the middle frame members 25A or 25B. The latch release cable 34 passes through the lock body 28 and cable guide 40 and into the middle frame member towards middle latch assembly 27. A release lever 42 is attached to the lock body for allowing the front hoop pivot body 26 to unlock and move between an open position and a folded position relative to the lock body 28. The release lever 42 is pivotally attached to the lock body 28 and includes a lock pin 44 inserted through the lock body 28 and first cam bore 46 and second cam bore 48. First and second cam bores 46 and 48 are preferably offset by approximately 180° around the cam 30. The release lever 42 may further include a release lever spring 49 such that the release lever 42 is biased towards a position where lock pin 44 is engaged with one of first and second cam bores 46 and 48.

Figure 7:
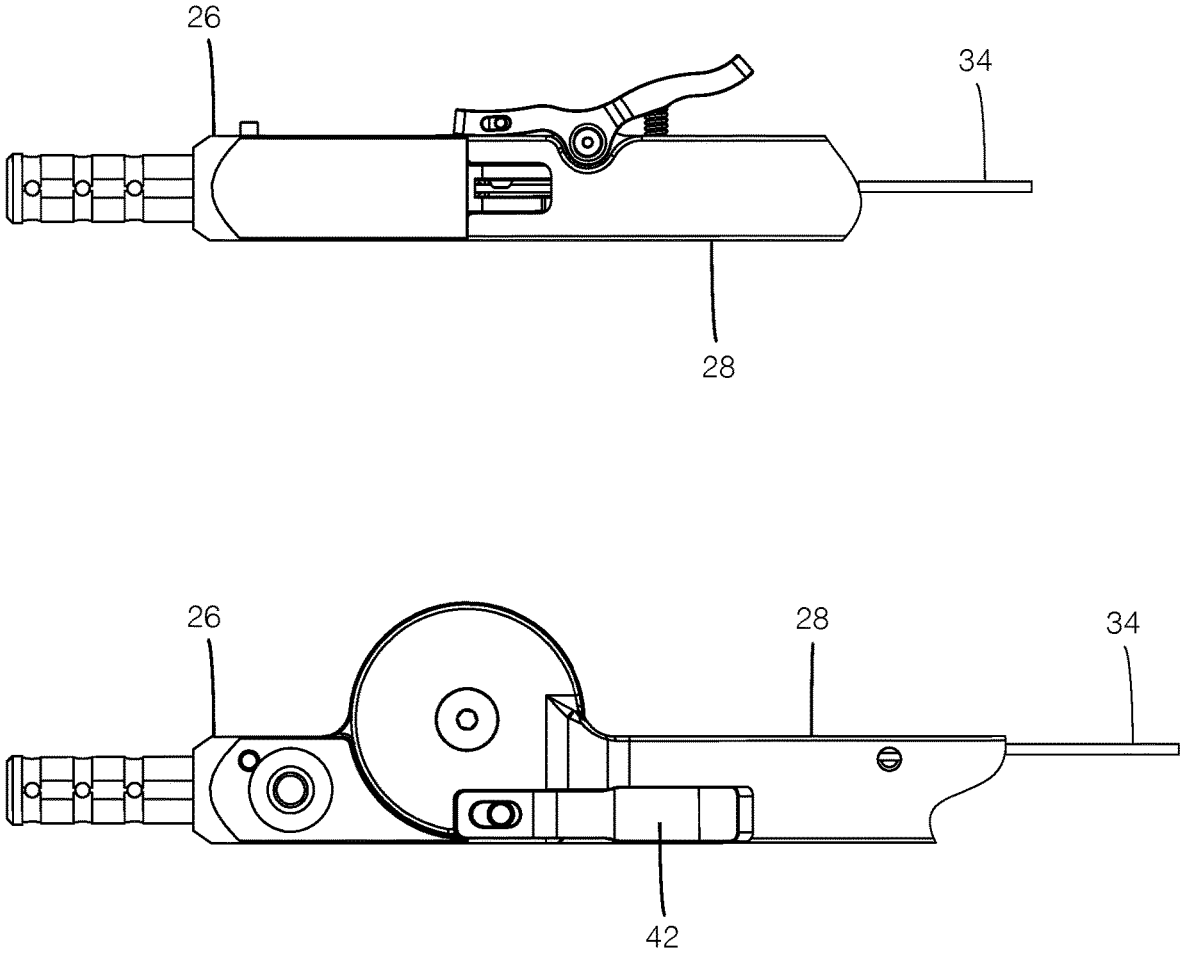
FIGS. 7-9 show side views of a front latch assembly of a folding bimini top moving from an open to a folded position according to one embodiment of the present disclosure.
Figure 8:
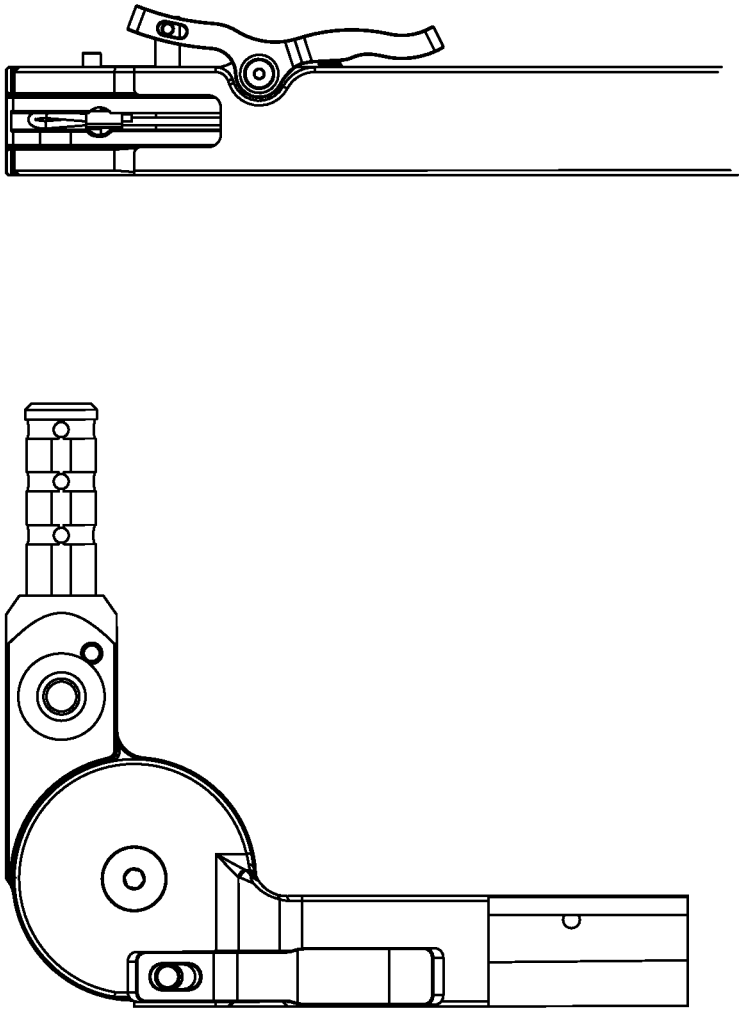
Figure 9:
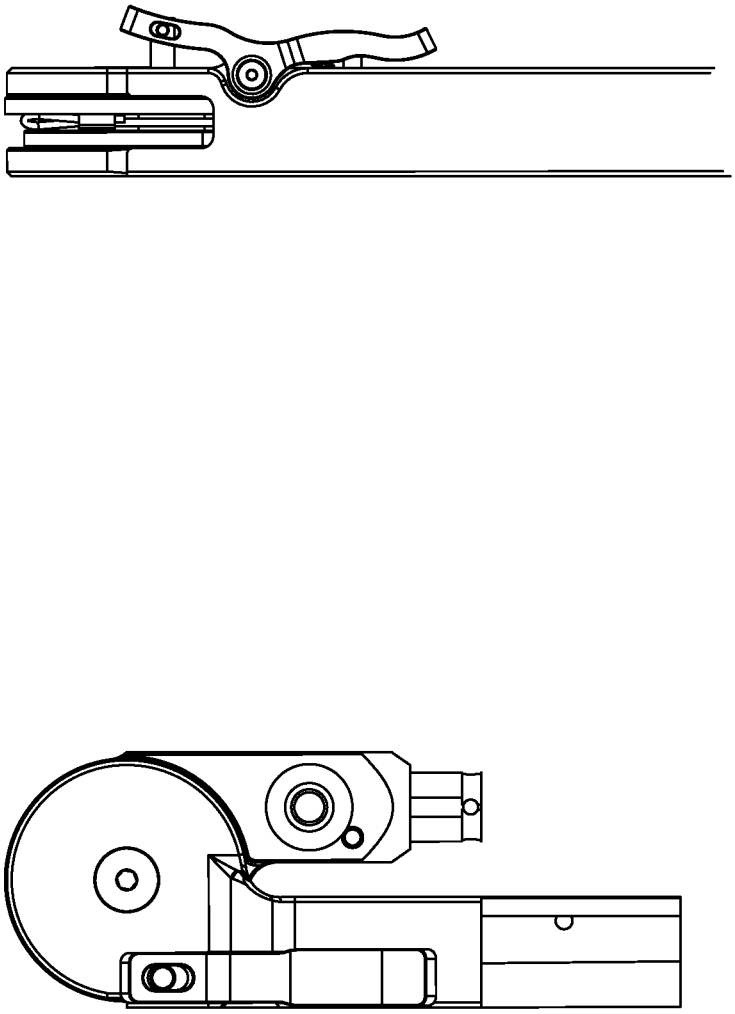

Referring now to FIGS. 7-9, the front latch assembly 24 pivots between an open and locked position (FIG. 7) and a folded locked position (FIG. 9). The front latch assembly 24 is in an open position when the folding bimini top 10 is in the open position illustrated in FIGS. 1-3. When a user depresses the release lever 42, the lock pin 44 is disengaged from the first cam bore 46 and the front latch assembly becomes unlocked such that the pivot body 26 is free to pivot with respect to the lock body 28, as shown in FIG. 8. When the front latch assembly 24 is moved fully to the folded position of FIG. 9, the lock pin 44 engages the second cam bore 48 to thereby lock the front latch assembly 24 in the folded position (shown in FIG. 5). In one preferable embodiment, only one of the pair of front latch assemblies 24A and 24B includes the second cam bore 48 to lock the front latch assembly in the folded position.

Figure 10:
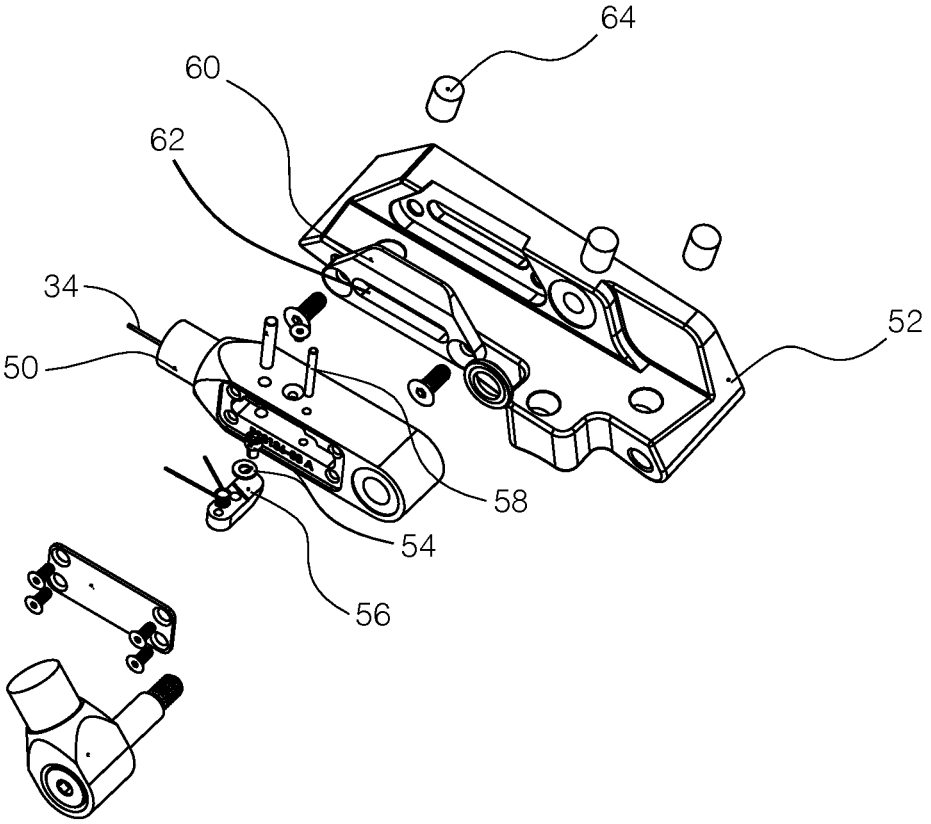
FIG. 10 shows an exploded view of a middle latch assembly of a folding bimini top according to one embodiment of the present disclosure.

Middle latch assemblies 27A and 27B are attached to middle frame members 25A and 25B. Referring to FIG. 10, middle latch assembly 27 includes a latch housing 50 pivotally attached to a latch mount 52. The latch release cable 34 extends from the front latch assembly 24 to the middle latch assembly 27 and enters the latch housing 50 where the release cable 34 is attached to a cable clamp 54 mounted on a latch 56. The latch 56 is movably attached to the latch housing 50, such as with pivot pin 58.

Figure 2:
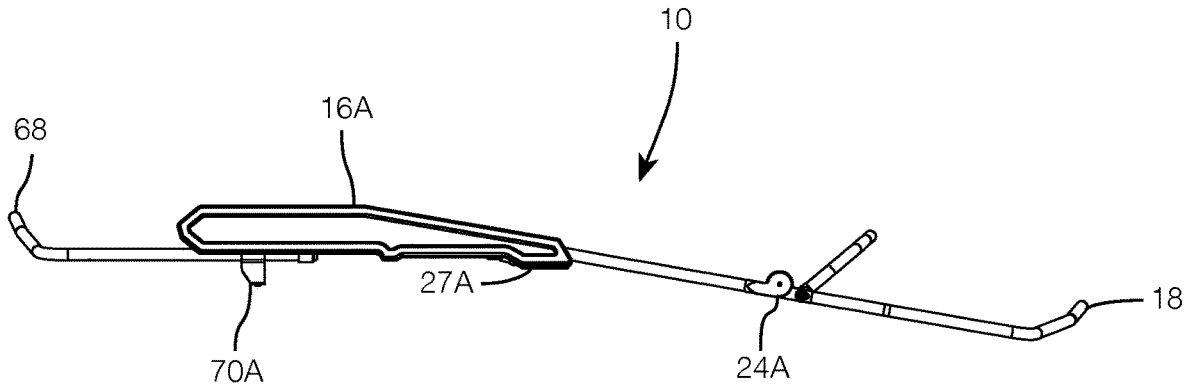
FIG. 2 shows a side view of a folding bimini top in an open position according to one embodiment of the present disclosure.

A striker plate 60 is attached to the latch mount 52 and includes a latch opening 62 for receiving the latch 56 to lock the middle latch assembly 27 in an open position. The latch mount 52 may include a plurality of bumpers 64 for contacting the middle frame members 25A and 25B or other portions of the folding bimini top frame 10 when the middle latch assembly 27 is in a closed folded position. The middle support arc 29 is pivotally attached to the middle latch assembly 27 at middle support arc mount 66. The latch mount 52 may be angled (FIGS. 11-13) so that the middle frame members 25A and 25B may extend at a downward angle relative to a horizontal plane and the front hoop 18 extends downward towards a bow of the watercraft 12, as shown in FIGS. 1 and 2.

Figure 11:
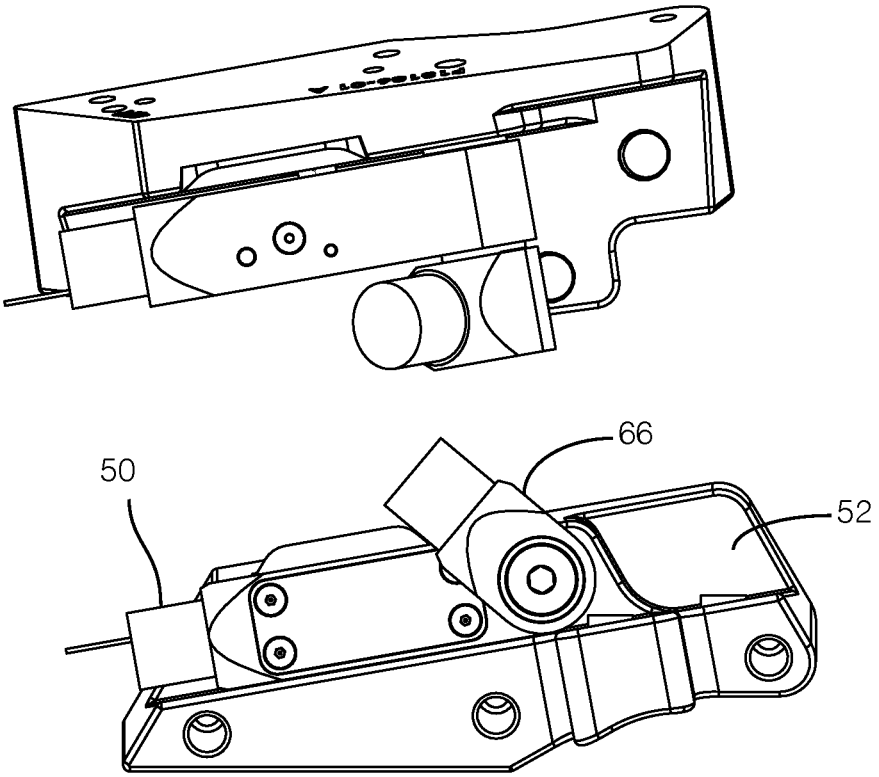
FIGS. 11-13 show side views of a middle latch assembly of a folding bimini top moving from an open to a folded position according to one embodiment of the present disclosure.
Figure 12:
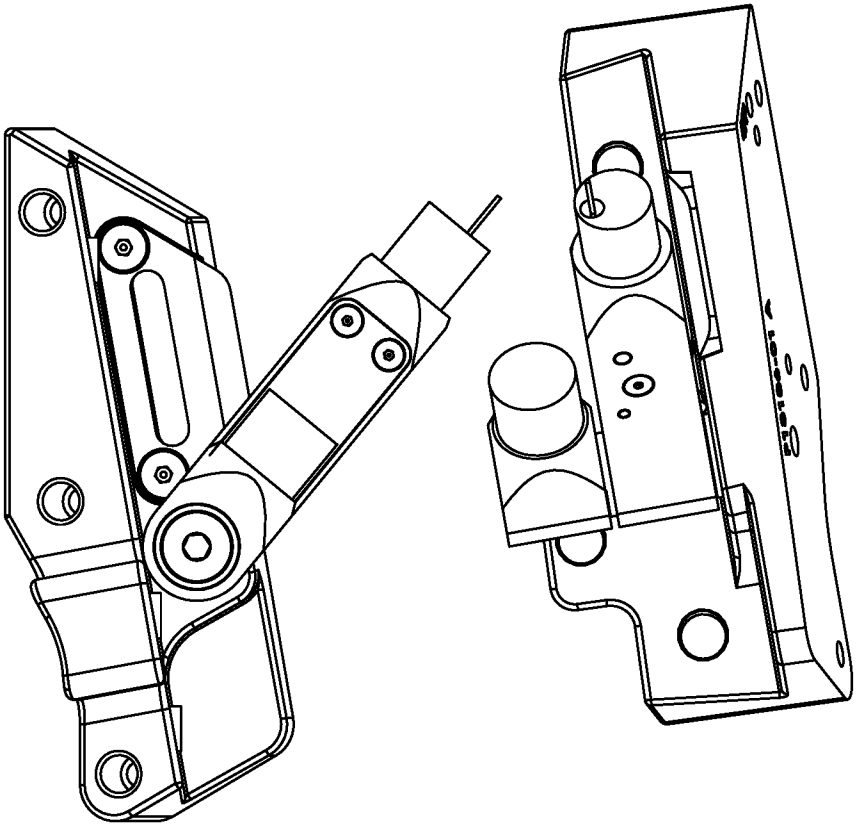
Figure 13:
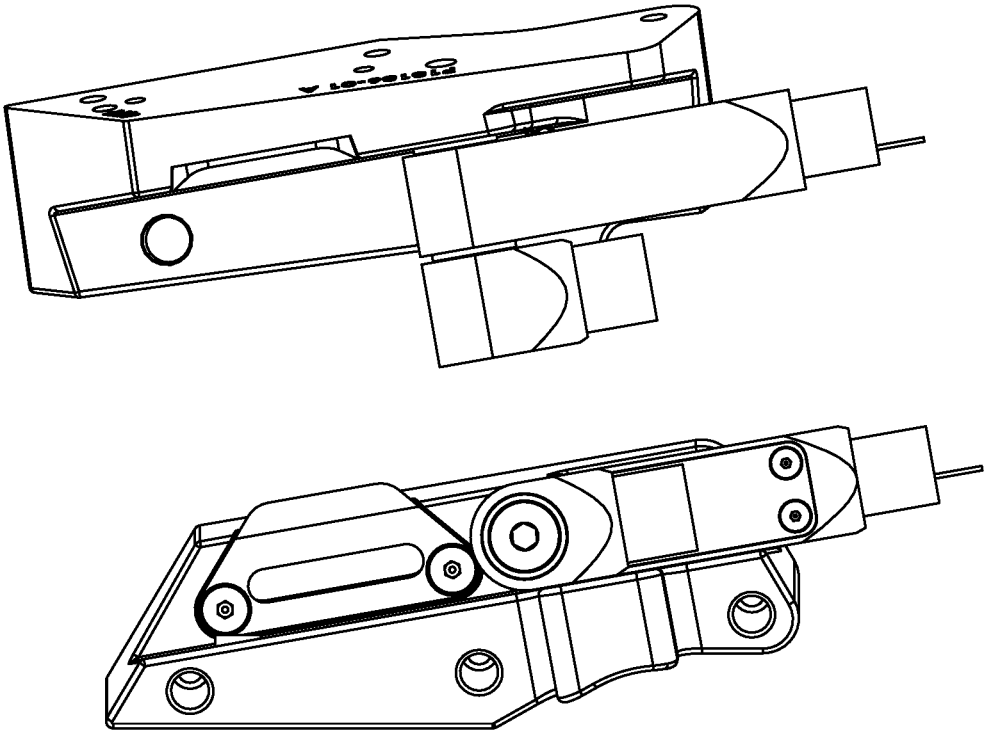
Figure 14:
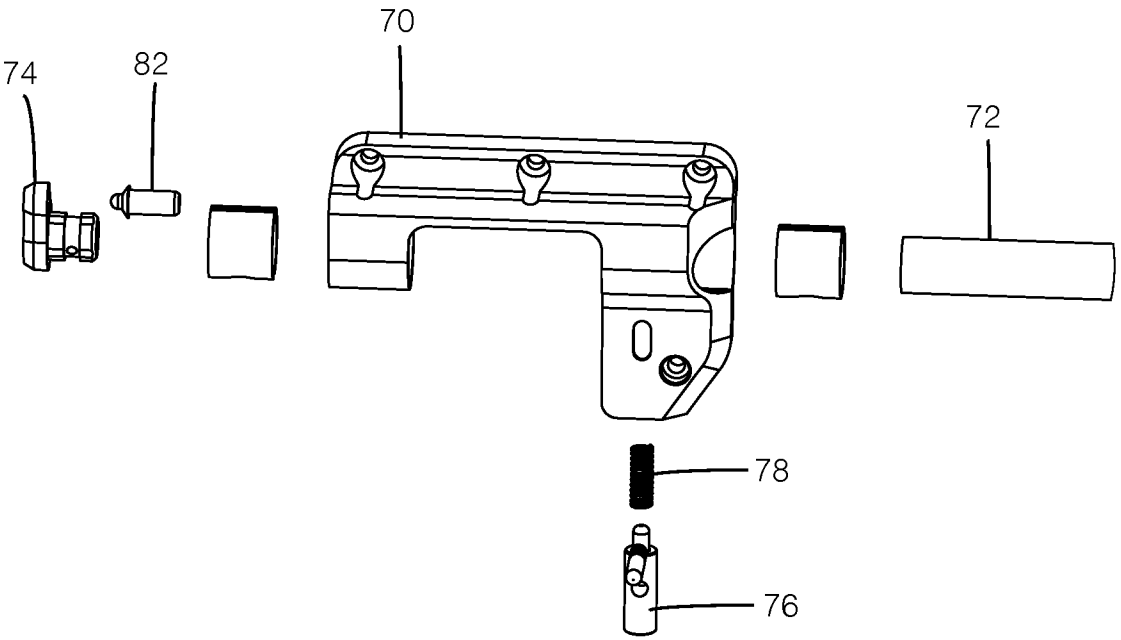
FIG. 14 shows an exploded view of a rear slide assembly of a folding bimini top according to one embodiment of the present disclosure.
Figure 15:
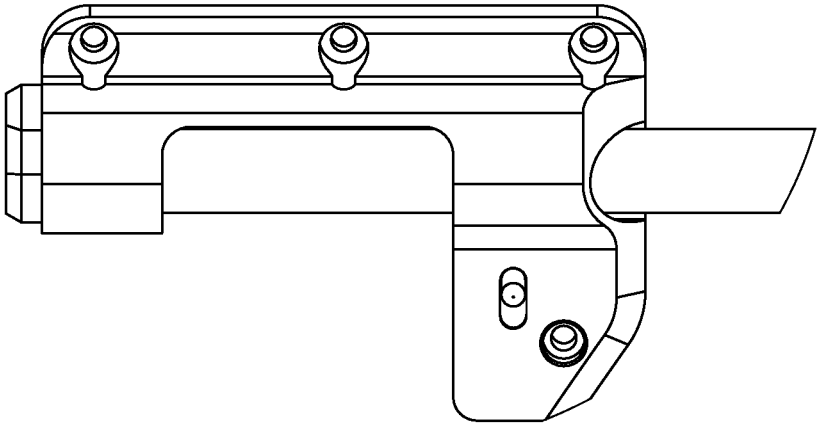
FIG. 15 shows a side view of a rear slide assembly of a folding bimini top in an open and locked position according to one embodiment of the present disclosure.
Figure 16:
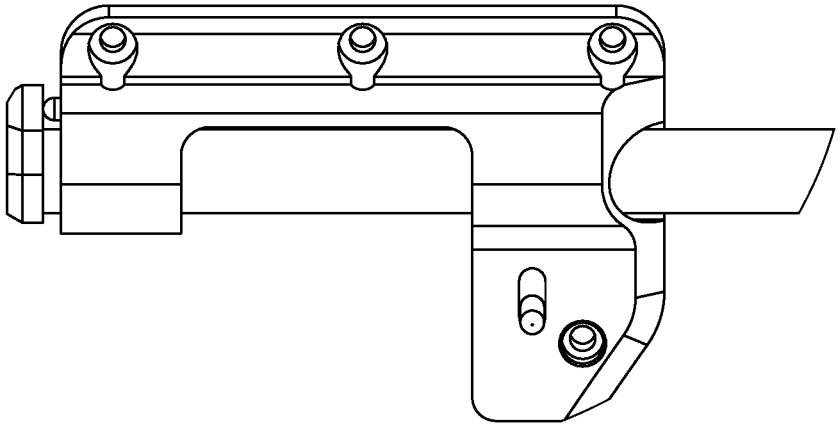
FIG. 16 shows a side view of a rear slide assembly of a folding bimini top in a middle position between open and folded positions according to one embodiment of the present disclosure.
Figure 17:
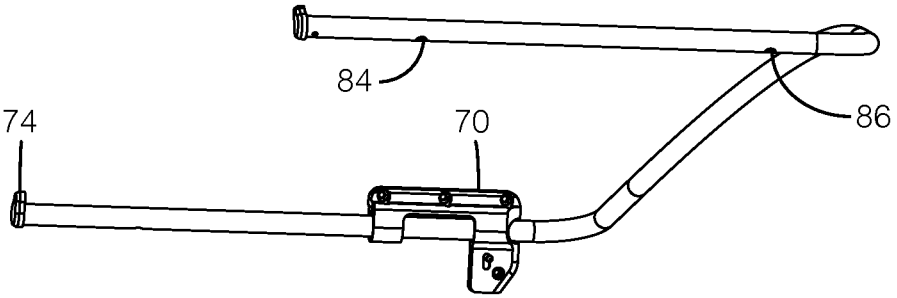
FIG. 17 shows a rear slide assembly and rear hoop of a folding bimini top in a closed position according to one embodiment of the present disclosure.

Referring now to FIGS. 11-13, the middle latch assembly 27 pivots between an open locked position (FIG. 11) and a closed folded position (FIG. 13). The middle latch assembly 27 is in an open locked position when the folding bimini top 10 is in the open position illustrated in FIGS. 1-3. The middle latch assembly 27 is unlocked and moves to the closed position when the front latch assembly 24 is unlocked and a user begins to fold the bimini top 10 which thereby pulls the latch release cable 34, as discussed in more detail below. When the latch release cable 34 is pulled, the latch 56 is disengaged from the striker plate 60 and the middle latch assembly 27 becomes free to pivot towards the closed and folded position. The middle latch assembly 27 passes through a middle position (FIGS. 4 and 12) to the closed position shown in FIG. 13. The latch housing 50 preferably rotates between about 90° and about 270° between open and closed positions, and preferably rotates approximately 180° from the open position to the closed and folded position.

The release cable 34 acts as a linkage between the front latch assembly 24 and middle latch assembly 27 such that unlocking and pivoting the front hoop 18 and front latch assembly releases the latch 56 of the middle latch assembly. The release cable 34 extends from the pivot body 26 of the front latch assembly 24 to latch 56 within the latch housing 50 of the middle latch assembly 27. While the present disclosure illustrates the linkage between the front latch assembly 24 and middle latch assembly 27 as a cable, it is also understood that various other linkages may be used, such as one or more rigid linkages connected between the front latch assembly 24 and middle latch assembly 27.

When a user desires to fold closed the front hoop 18 and middle frame assemblies 25A and 25B, the user first depresses the release lever 42 on the front latch assemblies 24A and 24B. When the user depresses the release lever 42, the lock pin 44 disengages the cam 30 and the pivot body 26 becomes free to pivot with respect to the lock body 28. As the pivot body 26 pivots relative to the lock body 28, the release cable 34 is pulled around the cam 30. The middle latch assemblies 27A and 27B may remain in the open and locked position until travel of the release cable 34 around the cam 30 is sufficient to pull the latch 56 such that the latch 56 becomes disengaged from the striker plate 60 of the latch mount 52. When the latch 56 disengages the striker plate 60, the middle frame members 25A and 25B are able to pivot (FIG. 4) towards a folded closed position of the bimini top frame 10 (FIG. 5).

Referring now to FIGS. 14-17, the folding bimini top frame 10 may include a sliding rear hoop 68 mounted to the end plates 16A and 16B with a pair of rear slide mounts 70A and 70B. Sliding rear hoop end 72 is inserted through rear slide mount 70 and rear stop 74 is attached to the rear slide hoop end 72. A plunger 76 is installed in the rear slide mount 70 adjacent to the inserted sliding rear hoop 68 and includes plunger spring 78 positioned such that the plunger 76 is urged towards a closed position in contact with the sliding rear hoop 68. The plunger 76 includes a lock handle 80 extending from a slide of the plunger 76. A tensioner 82, such as a resilient flexible nub or a spring, is installed on the rear slide mount 70 such that the tensioner 82 contacts the rear stop 74 and urges the rear stop 74 and attached sliding rear hoop 68 towards the closed position shown in FIG. 17. The sliding rear hoop 68 includes first lock bore 84 and second lock bore 86 for engaging the plunger 76 in open and closed sliding positions, as discussed below.

In a locked and open position (FIG. 15), the plunger 76 is engaged with first lock bore 84 such that the sliding rear hoop 68 is fully extended, as shown in FIGS. 1-3, and such that the rear stop 74 compresses the tensioner 82 and is adjacent to the rear slide mount 70. When a user desires to slide the sliding rear hoop 68 to a closed position (FIG. 17), the user pulls the lock handle 80 which disengages the plunger 76 from the first lock bore 84. The tensioner 82 initially urges the rear stop 74 away from the rear slide mount 70 and thereby prevents the plunger 76 from re-engaging the first lock bore 84 when the user releases the lock handle 80. The user may then slide the sliding rear hoop 68 towards the closed position shown in FIG. 17. When the plunger 76 is aligned with the second lock bore 86, the plunger 76 is urged to engage the second lock bore 86 by plunger spring 78, thereby locking the sliding rear hoop 68 in the closed position. To extend the sliding rear hoop 68, the user pulls the lock handle 80 to disengage the plunger 76 from the second lock bore 86 and slides the sliding rear hoop 68 to the open position.

A cover, such as a cover made from canvas or other like materials, is installed on the front hoop 18, front support arc 20, middle support arc 29, rear support arc 31, and sliding rear hoop 68. In an open position, the cover may be stretched over the folding bimini top frame 10 to provide shade or shelter to passengers of the watercraft 12. In the closed position, the cover may be folded with the various elements of the folding bimini top frame 10.

While the discussion above is with reference to the individual front latch assembly 24, middle latch assembly 27, and rear slide mount 70, it is understood that the folding bimini top frame 10 may include substantially identical front latch assemblies 24A and 24B, middle latch assemblies 27A and 27B, and rear slide mounts 70A and 70B. However, it is also understood that elements of each pair of assemblies may vary. For example, only one of the front latch assemblies 24A and 24B or rear slide mounts 70A and 70B may include a locking component that maintains the folding bimini top frame 10 in the closed position.

The folding bimini top frame 10 of the present disclosure advantageously allows a user to readily move the folding bimini top frame 10 between open and closed positions depending on whether the user desires the folding bimini top frame to be deployed. The front latch assembly 24 and middle latch assembly 27 securely maintain the bimini top frame 10 in an open position and provide a sturdy frame for mounting of a cover. The folding bimini top frame 10 is readily closed by the user by engaging the release lever 42 of the front latch assemblies 24A and 24B. Because the front latch assemblies 24A and 24B and middle latch assemblies 27A and 27B are linked, when the user releases the front latch assemblies and begins to fold the folding bimini top frame 10, the middle latch assemblies 27A and 27B are also released, thereby allowing the folding bimini top frame 10 to be fully folded in a closed position.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A folding bimini top frame mountable on a tower of a watercraft, the folding bimini top frame comprising:

a base mounted on the tower of the watercraft;

a first frame portion pivotally associated with a second frame portion with a first latching hinge, the first latching hinge movable between a folded position and a deployed and locked position, the first latching hinge including a release lever for releasing the first frame portion from the deployed and locked position;

a second latching hinge mounted on the base and pivotally associated with the second frame member, the second latching hinge pivotable between a folded position and a deployed and locked position, the second latching hinge including a releasable latch for securing the second latching hinge in the deployed position; and a latch release mechanism in communication with the first latching hinge and the releasable latch of the second latching hinge, wherein the releasable latch of the second latching hinge is released by the latch release mechanism when the first frame portion is released from the deployed and locked position.

2. The folding bimini top frame of claim 1, further comprising a rear hoop movably attached to the base of the folding bimini top frame movable between a stowed position and a deployed position.

3. The folding bimini top frame of claim 2, wherein the rear hoop is slidably moved from the stowed position and the deployed position.

4. The folding bimini top frame of claim 1, wherein the latch release mechanism comprises a cable attached at a first end to the first latching hinge and at a second end to the releasable latch of the second latching hinge.

5. The folding bimini top frame of claim 4, the first latching hinge further including a cam pivotally associated with the first latching hinge, wherein the cam rotates when the first latching hinge moves between the folded position and the deployed position, and wherein when the first latching hinge pivots from the deployed position to the folded position, the cable releases the releasable latch of the second latching hinge.

6. The folding bimini top frame of claim 1, the first latching hinge further comprising:

a pivot body pivotally attached to a lock body;

a cam attached to the pivot body, the cam including a first cam bore formed therethrough;

a lock pin movably attached to the lock body and in communication with the release lever and shaped to engage the first cam bore formed through the cam;

wherein the lock pin engages the first cam bore of the cam to secure the first latching hinge in the deployed and locked position.

7. The folding bimini top frame of claim 6, the first latching hinge further comprising a second cam bore formed through the cam attached to the pivot body, wherein the lock pin engages the second cam bore to secure the first latching hinge in the folded position.

8. The folding bimini top frame of claim 6, wherein the latch release mechanism comprises a cable attached at a first end to the cam of the first latching hinge and at a second end to the releasable latch of the second latching hinge.

9. The folding bimini top frame of claim 8, wherein the cable extends from the first latching hinge to the second latching within the second frame portion.

10. The folding bimini top frame of claim 1, the second latching hinge further comprising:

a latch housing pivotally attached to a latch mount, the releasable latch movably mounted on the latch housing;

a striker plate attached to the latch mount, the striker plate including an opening shaped to receive the releasable latch when the second latching hinge is in the deployed position.

11. The folding bimini top frame of claim 10, further comprising a plurality of bumpers formed on the latch mount for contacting the second frame portion when the second latching hinge is in the folded position.

12. A folding bimini top frame mountable on a tower of a watercraft, the folding bimini top frame comprising:

at least one base mounted on the tower of the watercraft;

a first frame portion pivotally associated with a second frame portion with a pair of first latching hinges, each of the pair of first latching hinges movable between a folded position and a deployed and locked position, at least one of the first latching hinge including a release lever for releasing the first frame portion from the deployed and locked position;

a pair of second latching hinges mounted on the base and pivotally associated with the second frame member, the pair of second latching hinges pivotable between a folded position and a deployed and locked position, at least one of the pair of second latching hinges including a releasable latch for securing at least one of the pair of second latching hinges in the deployed position; and a latch release mechanism in communication with one of the first latching hinges and the releasable latch of at least one of the pair of second latching hinges, wherein the releasable latch of the second latching hinge is released by the latch release mechanism when the first frame portion is released from the deployed and locked position.

13. The folding bimini top frame of claim 12, further comprising a front support arc mounted between the pair of first latching hinges.

14. The folding bimini top frame of claim 13, wherein the foldable front support arc is pivotally mounted to the pair of first latching hinges.

15. The folding bimini top frame of claim 12, further comprising a rear hoop movably attached to the base of the folding bimini top frame movable between a stowed position and a deployed position.

16. The folding bimini top frame of claim 15, wherein the rear hoop is slidably moved from the stowed position and the deployed position.

17. The folding bimini top frame of claim 12, further comprising a foldable middle support arc extending between the pair of second latching hinges.

18. A folding bimini top frame comprising:

a base;

a first frame portion pivotally associated with a second frame portion with a first latching hinge, the first latching hinge movable between a folded position and a deployed and locked position, the first latching hinge including a release lever for releasing the first frame portion from the deployed and locked position;

a second latching hinge mounted on the base and pivotally associated with the second frame member, the second latching hinge pivotable between a folded position and a deployed and locked position, the second latching hinge including a releasable latch for securing the second latching hinge in the deployed position; and a latch release mechanism in communication with the first latching hinge and the releasable latch of the second latching hinge comprising a cable attached at a first end to the first latching hinge and at a second end to the releasable latch of the second latching hinge, wherein the releasable latch of the second latching hinge is released by the latch release mechanism when the first frame portion is released from the deployed and locked position.

* * * * *